US009512737B2

(12) United States Patent
Hatcher, Jr. et al.

(10) Patent No.: US 9,512,737 B2
(45) Date of Patent: Dec. 6, 2016

(54) STANDARDIZED GAS TURBINE INSPECTION PORT SYSTEM

(71) Applicant: Siemens Energy, Inc., Orlando, FL (US)

(72) Inventors: Clifford Hatcher, Jr., Orlando, FL (US); James P. Williams, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 628 days.

(21) Appl. No.: 14/070,610

(22) Filed: Nov. 4, 2013

(65) Prior Publication Data

US 2015/0125267 A1 May 7, 2015

(51) Int. Cl.
*F01D 21/00* (2006.01)
*F01D 25/24* (2006.01)

(52) U.S. Cl.
CPC ..... *F01D 21/003* (2013.01); *F01D 25/24* (2013.01); *Y10T 29/49238* (2015.01)

(58) Field of Classification Search
CPC ..... F01D 25/24; F01D 21/20; F01D 21/003; F01D 21/00; Y10T 29/49238
USPC ..... 415/118
See application file for complete search history.

(56) References Cited

U.S. PATENT DOCUMENTS 3,936,217 A 2/1976 Travaglini et al.
5,115,636 A * 5/1992 Zeiser ..... F01D 21/003 415/118

* cited by examiner

*Primary Examiner* — Richard Edgar

(57) ABSTRACT

A standardized inspection port system with common inspection port bodies and port plugs are incorporated in plural inspection locations within a gas turbine engine casing to facilitate internal engine inspection. The inspection ports preferably have identical internal diameter, stub flange dimensions and axial length from the gas turbine casing inspection seat to the stub flange for standardized mounting of inspection instruments at different locations about the turbine. The inspection port system components are preferably axially and radially aligned along the turbine casing for establishing a common reference position along all turbine blade/vane rows. The port plug incorporates a magnetically attractive pole piece for concentration or redirection of an attractive magnetic field circuit generated by an inspection port plug service tool during plug insertion or retrieval. Magnetic attraction to a service tool enhances controlled plug guidance and reduces likelihood of inadvertent plug loss within the turbine casing.

20 Claims, 5 Drawing Sheets

STANDARDIZED GAS TURBINE INSPECTION PORT SYSTEM

BACKGROUND OF THE INVENTION

1. Field of the Invention

The invention relates to inspection port systems that facilitate internal inspection of gas turbine engines. More particularly, the invention relates to a standardized gas turbine inspection port system with port and port plug that are utilized throughout the engine. Preferably the each inspection location on the gas turbine that utilizes the standardized inspection port system has identical component dimensions and are oriented along common axial and radial positions (e.g., 6 o'clock and/or 12 o'clock radial orientation) to facilitate internal inspection of all corresponding blade/vanes that share a common row about the entire turbine casing circumference.

2. Description of the Prior Art

Industrial gas turbine engines are often equipped with inspection port systems that facilitate inspection instrument access to turbine internal components from the exterior of the turbine casing. U.S. Pat. No. 3,936,217, the entire contents of which is incorporated by reference herein, shows a typical inspection port system with a cylindrical inspection port, mating port plug that seals the inspection port, and external flanged port member projection outside the turbine casing (also referred to as a stub tube tube). The port plug and cylindrical inspection port have mating complimentary interlocking lug pins and J slots that function as a securing mechanism to retain the plug with the port. Another known plug/port securing mechanism are mating male and female threads.

Port plugs are inserted into the gas turbine inspection port system by advancing the elongated plug into the turbine casing through the stub tube. Thereafter the plug tip is inserted into the relatively narrow diameter inspection port tube along a narrow alignment path, which is analogous to threading a needle, while taking care not to drop the plug into the turbine casing.

Individual inspection port system access locations and dimensions on a gas turbine engine vary among engine designs. For example, different inspection rows within a gas turbine compressor or combustor section often have different length dimensions between the gas turbine casing inspection hole and the stub tube flange, as well as different port diameters. Often the flange dimension and configuration for each respective stub tube will vary on the same turbine and radial position about the case circumference will also vary from one row to another or among different turbine models. Lack of uniformity raises inspection service challenges. For example, an inspection tool suitable for one inspection row may be too large in diameter or length for a different inspection port system access point in the same or in a different inspection row. Length variances between a stub tube flange and gas turbine casing inspection hole often requires a service technician to configure inspection instruments differently from row to row so that instrument insertion distance can be correlated with instrument orientation within the turbine casing. Different stub tube flange configurations and/or dimensions requires different instrument anchoring or other securement methods relative to the turbine casing or perhaps use of adapter flanges.

Thus, a need exists in the art for a standardized gas turbine engine inspection port system that enhances engine inspection and maintenance by providing preferably identically dimensioned access paths and external anchoring flanges for inspection tool and other service tool insertion into the gas turbine engine, with system ports arrayed along common aligned locations in a plurality of turbine blade/vane rows.

An additional need exists for an inspection port plug and plug installation/removal service method that facilitates easy plug insertion and alignment into an inspection port system inspection port body, with reliable sealing of the gas turbine casing inspection hole.

Another need exists for an inspection port plug and plug installation/removal service method that reduces likelihood of inadvertently dropping a port plug into the gas turbine casing during removal or installation.

SUMMARY OF THE INVENTION

Accordingly, a suggested object of the invention is to enhance engine inspection and maintenance by providing a standardized gas turbine engine inspection port system with preferably identically dimensioned access paths and external anchoring flanges for inspection tool and other service tool insertion into the gas turbine engine, with system ports arrayed along common aligned locations in a plurality of turbine blade/vane rows.

An additional suggested object of the invention is to facilitate easier port plug insertion and alignment into an inspection port system inspection port body, with reliable sealing of the gas turbine casing inspection hole, than presently know inspection port systems.

Another suggested object of the invention is to reduce likelihood of inadvertently dropping a port plug into the gas turbine casing during removal or installation.

These and other objects are achieved in one or more embodiments of the invention by a standardized port inspection system that is incorporated in plural locations within a gas turbine engine casing, to facilitate internal engine inspection. Inspection port system components that are incorporated in the inspection system, including for example inspection port bodies, port plugs, stub pipes and inspection flanges, preferably have identical internal diameter, stub flange dimensions and axial length from the gas turbine casing inspection seat to the stub flange for standardized mounting of inspection instruments at different locations about the turbine. The access inspection ports of the port inspection system are preferably axially and radially aligned along the turbine casing (e.g., at the 6 o'clock, 12 o'clock or both radial positions) for establishing a common reference position along all turbine blade/vane rows. The inspection system port plug incorporates a magnetically attractive pole piece constructed of material having a magnetic permeability greater than the remainder of the plug for concentration or redirection of an attractive magnetic field circuit generated by an inspection port plug service tool during plug insertion or retrieval. Magnetic attraction to a service tool facilitates port plug insertion and retrieval from the inspection port along precisely maneuvering paths and reduces likelihood of inadvertent dropping of a port plug into the gas turbine casing during plug maneuvering.

Embodiments of the invention feature a gas turbine inspection port plug apparatus for insertion into a mating gas turbine inspection port of a turbine inspection port system that is coupled to a gas turbine engine casing. The port plug has an elongated plug shaft, constructed of a material having a first magnetic permeability, for insertion into a mating gas turbine inspection port. The port plug also has a plug seating surface on a distal end of the plug shaft, for sealing engagement with a mating inspection opening seat defined by a gas turbine engine casing upon insertion of the plug shaft into a gas turbine inspection port. There is a plug cap on a proximal end of the plug shaft. Preferably the port plug also has a plug securing mechanism, for retention engagement with a complementary gas turbine inspection port securing mechanism when the plug is inserted into an inspection port. A magnetically attractive pole piece constructed of material having a second magnetic permeability greater than the first magnetic permeability is oriented in proximity to the plug shaft proximal end, for concentration or redirection of an attractive magnetic field circuit generated by an inspection port plug service tool during plug insertion or retrieval. For example the pole piece may be coupled to a proximal end of the cap opposite to its connection to the plug shaft proximal end. The pole piece may be constructed of a magnetic lamina stack and may be shaped to direct the service tool generated magnetic field. The plug securing mechanism may comprise threads configured for complimentary mating engagement with threads formed in the inspection port, including interrupted thread patterns that facilitate retention by push and twist motion. The plug securing mechanism alternatively may comprise lugs or lug-receiving slots formed in the plug for twist-lock engagement with corresponding mating lugs or slots formed in a complimentary gas turbine inspection port securing mechanism; and a biasing element coupled to the plug for axially biasing the plug securing mechanism relative to a complimentary gas turbine inspection port securing mechanism, such as a spring-biased J-lock retention mechanism. Any known form of plug/inspection port retention mechanisms may be utilized in connection with the inspection port plugs of the invention.

Other embodiments of the invention feature a method for servicing an inspection port plug adapted for sealing an inspection port of a gas turbine engine inspection port system in a gas turbine engine having a turbine casing enclosing plural axially spaced rows of vanes and blades that are oriented radially about a turbine shaft and an axially aligned inspection opening defined by the turbine casing, having an inspection opening seat. In the gas turbine an inspection port is affixed to the turbine casing in general axial alignment with the inspection opening seat. The inspection port has a generally cylindrical port body, a funnel on a proximal end of the port body, and a gas turbine inspection port securing mechanism. The turbine port inspection system has an inspection port plug that includes an elongated plug shaft, constructed of a material having a first magnetic permeability, for insertion into the gas turbine inspection port. The port plug has a plug seating surface on a distal end of the plug shaft, for sealing engagement with the mating inspection opening seat defined by a gas turbine engine casing upon insertion of the plug shaft into the inspection port. The port plug has a plug cap on a proximal end of the plug shaft and a plug securing mechanism, for retention engagement with the complementary gas turbine inspection port securing mechanism when the plug is inserted therein. A magnetically attractive pole piece constructed of material having a second magnetic permeability greater than the first magnetic permeability, is oriented in proximity to the plug shaft proximal end, for concentration or redirection of an attractive magnetic field circuit generated by an inspection port plug service tool during plug insertion or retrieval. An inspection port plug service tool having a magnetic tip for generation of an attractive magnetic field circuit with the plug pole piece during plug insertion or retrieval is used during plug service.

When installing the port plug within the gas turbine in accordance with the method of the invention, the service tool magnetic tip and the pole piece are magnetically coupled, so that the inspection port plug is affixed to the service tool. Then the inspection port plug seating surface and plug are inserted into the inspection port funnel with the service tool and advanced therein to place the plug seating surface into contact with the turbine casing inspection opening seat. The respective mating plug and inspection port securing mechanisms are then engaged for retaining the port plug in the inspection port. When removing the port plug from the gas turbine, the respective mating plug and inspection port securing mechanisms are disengaged so that the port plug is separable from the inspection port then the service tool magnetic tip and the pole piece are magnetically coupled, so that the inspection port plug is affixed to the service tool. Then the port plug is removed from the inspection port and gas turbine.

Embodiments of the invention also feature a gas turbine engine with the standardized port inspection system. This invention embodiment gas turbine engine includes nested inner and outer turbine casings enclosing plural axially spaced rows of vanes and blades that are oriented radially about a turbine shaft. Plural axially aligned inspection openings are defined by the inner turbine casing, each having an inspection opening seat. A plurality of inspection ports are affixed to the inner turbine casing in general axial alignment with each respective inspection opening seat. Each inspection port has a generally cylindrical port body having a distal end for affixation to the inner casing in general axial alignment with an inspection opening seat defined by the inner casing. The respective port bodies preferably have identically dimensioned internal length and diameter. The port body proximal end facing the outer casing has a funnel. The inspection port body also has a gas turbine inspection port securing mechanism. A plurality of generally cylindrical stub tubes are affixed to and project outwardly from the outer turbine casing, each preferably having identical external flanges and inner diameters, all of which are in general axial alignment with each respective inspection opening seat and respective inspection port body. Preferably the axial length of each stub tube is chosen so that distance from its respective external flange to its corresponding respective inspection opening seat is identical or substantially identical. Each corresponding stub tube, inspection port and inspection opening seat are preferably aligned axially and radially: for example at a 6 o'clock or a 12 o'clock position or at both positions. The gas turbine has plural gas turbine inspection port plugs for insertion into a mating gas turbine inspection port. Each port plug has an elongated plug shaft, constructed of a material having a first magnetic permeability, such as Inconel® superalloy, for insertion into a mating gas turbine inspection port. A plug seating surface is formed on a distal end of the plug shaft, for sealing engagement with a mating inspection opening seat defined by a gas turbine engine casing upon insertion of the plug shaft into a corresponding gas turbine inspection port. A plug cap is formed on a proximal end of the plug shaft. The port plug has a plug securing mechanism, for retention engagement with a complementary gas turbine inspection port securing mechanism when the plug is inserted into an inspection port, and a magnetically attractive pole piece constructed of material having a second magnetic permeability greater than the first magnetic permeability, such as a ferro magnetic alloy, oriented in proximity to the plug shaft proximal end, for concentration or redirection of an attractive magnetic field circuit generated by an inspection port plug service tool during plug insertion or retrieval.

The respective objects and features of the present invention may be applied jointly or severally in any combination or sub-combination by those skilled in the art.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of the embodiments of the invention can be readily utilized in gas turbine inspection port systems. By utilizing standardized inspection port system components that are preferably of identical or substantially identical configuration and dimensions, which also preferably are arrayed in commonly aligned axial and radial orientations about a gas turbine casing—internal turbine inspections can be performed using the same inspection equipment, equipment configuration and inspection techniques consistently from row-to-row. Common inspection system port locations from row-to-row also enhances consistent inspection of all circumferential positions within the casing. For example, inspection port alignment at the 12 o'clock or vertical radial position facilitates insertion of flexible inspection probes clockwise and/or counter-clockwise throughout the turbine casing inner circumference, for inspection of abradable surfaces or vane carriers. Similarly, insertion of a blade inspection probe at the 12 o'clock position facilitates easier inspection of all blades while the turbine is in turning gear inspection mode. The magnetically attractive port plug pole piece, in cooperation with a magnetic field generating service tool facilitates precise "thread the needle" maneuvering of the port plug into its mating funnel-necked inspection port body and subsequent firm sealing of the corresponding turbine inspection opening after cooperative mating engagement of the respective port plug and port body securing mechanisms. In embodiments of the invention the mating securing mechanisms are relatively easy to engage "push and twist-lock" J locking mechanisms or interrupted thread mechanisms. Other embodiments of securing mechanisms include mating threads on the port plug and inspection port body.

Figure 1:
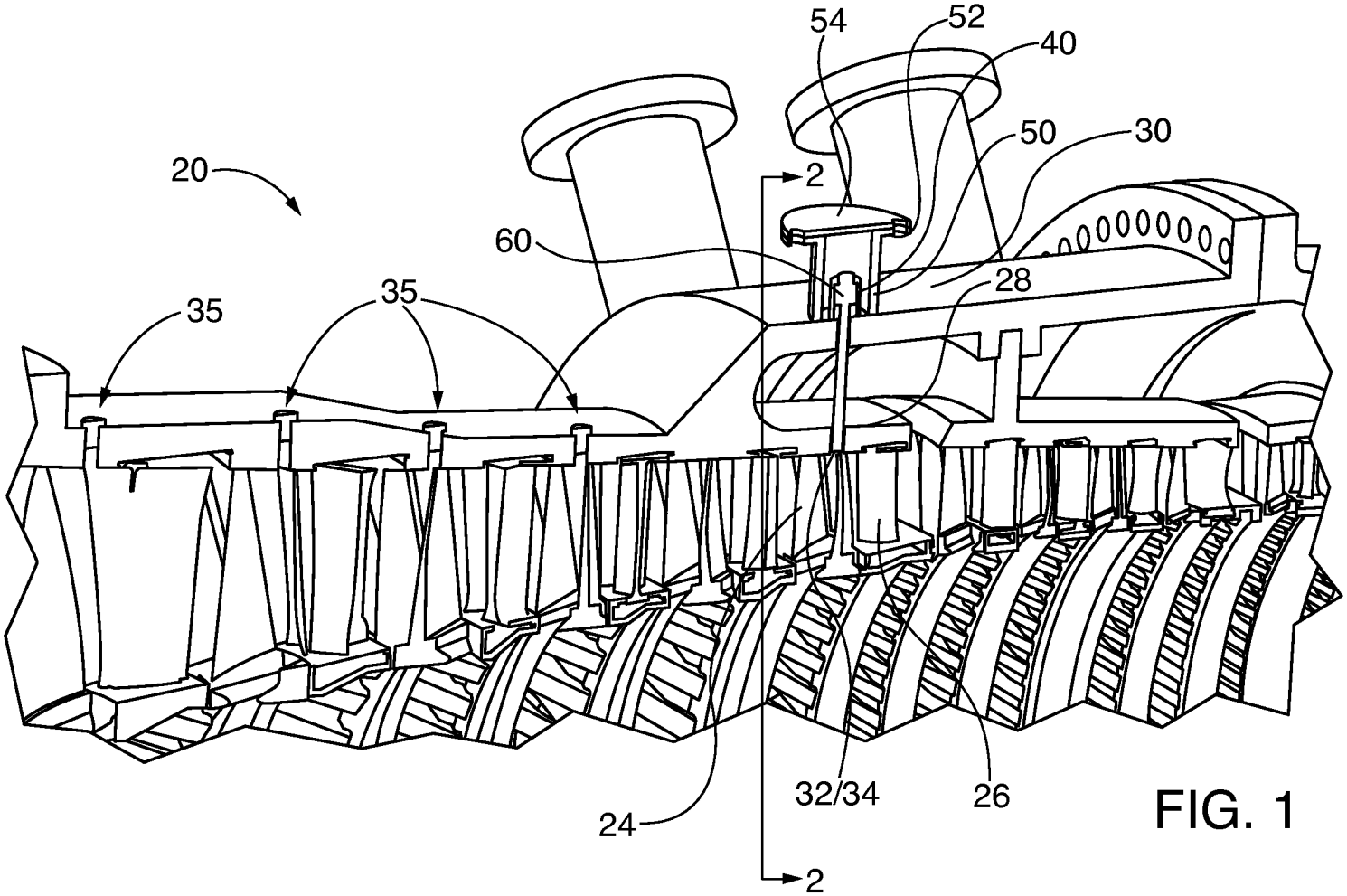
FIG. 1 is a partial cut-away perspective view of an industrial gas turbine engine incorporating embodiments of inspection ports and port plugs of the invention that are oriented in axial alignment at the 12 o'clock or top radial position on the turbine casing.
Figure 2:
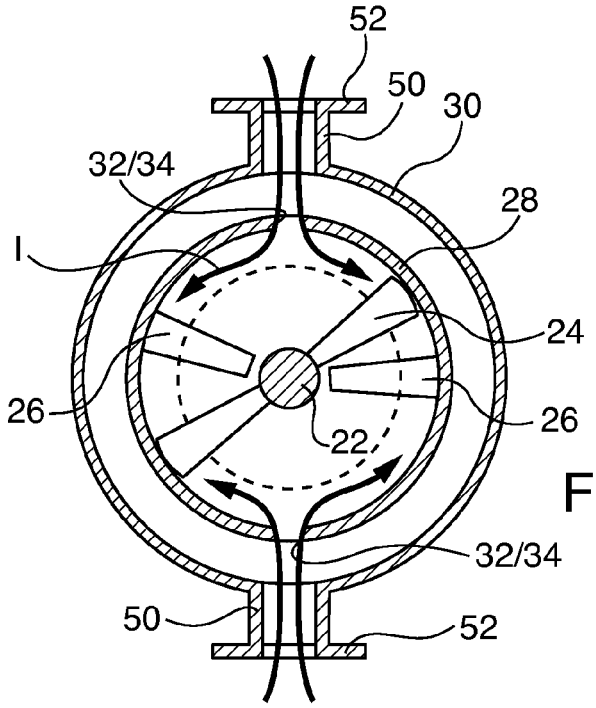
FIG. 2 is a schematic cross sectional view of the industrial gas turbine engine of FIG. 1, incorporating embodiments of inspection ports and port plugs of the invention that are oriented in axial alignment at the 12 o'clock and the 6 o'clock or bottom radial position on the turbine casing, and suggested inspection tool access paths clockwise and counterclockwise relative to each access port for inspection of all blades and vanes with the inspection row.

FIGS. 1-4 show an exemplary gas turbine 20 with a gas turbine shaft 22 carrying rotating turbine blades 24. Stationary vanes 26 are coupled to the inner turbine casing 28. The inner turbine casing 28 is circumscribed by an outer turbine casing 30 or a shroud structure (not shown). The inner turbine casing 28, which may include additional internal lining structures, such as vane carriers or shrouds as well as turbine blade tip abradable shrouds that are not described herein, defines inspection openings 32 for insertion of inspection tools or inspection instruments 36 into the turbine interior. Each inspection opening 32 has an associated inspection opening seat 34 for sealing engagement with a port plug that is retained in an inspection port 40. Alternative presently sealed inspection openings 35 that are also capable of being converted to inspection port system inspection sites are shown in FIG. 1.

Figure 3:
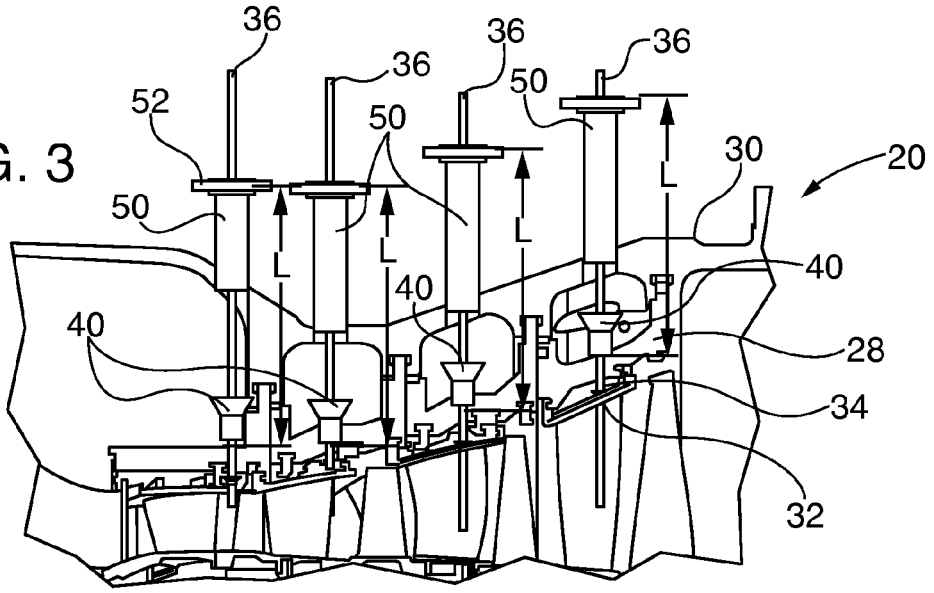
FIG. 3 is a partial cut-away perspective view of an industrial gas turbine engine incorporating embodiments of inspection ports and stub tubes of the invention with an inspection tool inserted in each inspection port.
Figure 4:
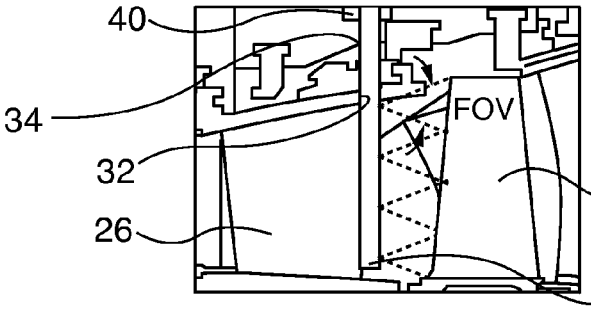
FIG. 4 is a detailed view of an inspection tool inserted within an inspection port embodiment of the invention that is being used to inspect a gas turbine blade.

Each inspection port 40 is preferably aligned concentrically with a corresponding turbine casing inspection opening 32, inspection opening seat 34, stub pipe 50 and external flange 52. The external flange 52 provides structural support for inspection instruments 36 that are coupled thereto. As previously noted, and shown in FIGS. 2-4, a plurality of inspection port system inspection sites are axially and radially aligned along different vane/blade rows. An exemplary alignment array is a row of axially aligned inspection ports at the top or 12 o'clock radial position, the bottom or 6 o'clock radial position, or at both locations. The inspection port system inspection site alignment may reconfigured for different field applications. Turbine inspection port system components are preferably configured and dimensioned identically, or substantially identically to facilitate standardized inspection tool applications and configurations, if desired. As shown in FIG. 3, the length L between the stub tube 50 external flange 52 to its corresponding respective inspection opening seat 32 is identical or substantially identical. in this manner any inspection instrument 36 that is inserted a selected depth within an inspection port site in one turbine blade/vane row will be inserted to the same relative depth in another turbine blade/vane row. Similarly, referring to FIG. 6, the internal diameter of the inspection port 40 and other upstream inspection port system components such as the stub pipe 50 is at least as large as the inner turbine casing inspection opening 32 diameter D. If the respective turbine casing inspection opening diameters D are substantially identical a given inspection instrument that is configured for insertion into one inspection opening should be capable for insertion into other inspection openings within the turbine casing 28.

Figure 5:
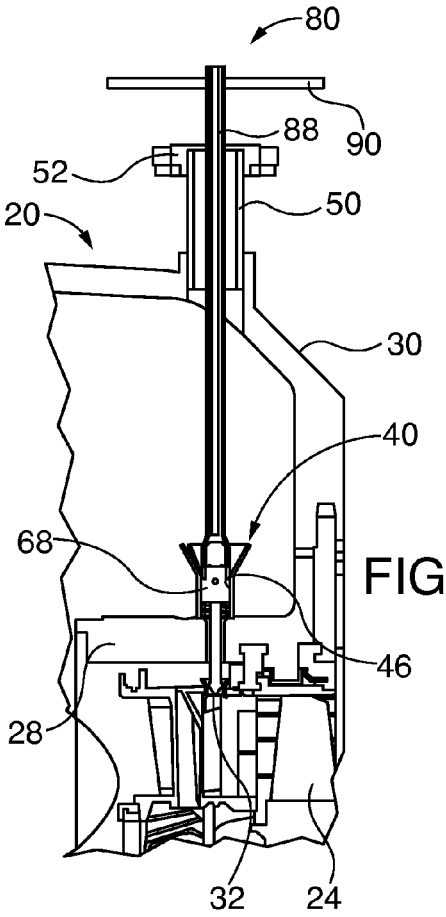
FIG. 5 is an elevational cross sectional view of a port plug embodiment of the invention being installed into an inspection port embodiment of the invention with a port plug service tool embodiment of the invention.
Figure 6:
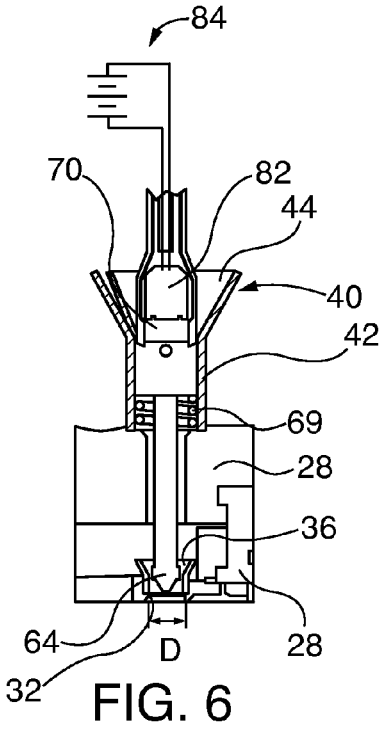
FIG. 6 is a detailed elevational view of FIG. 5, with the port plug engaged within the inspection port by the port plug service tool.
Figure 7:
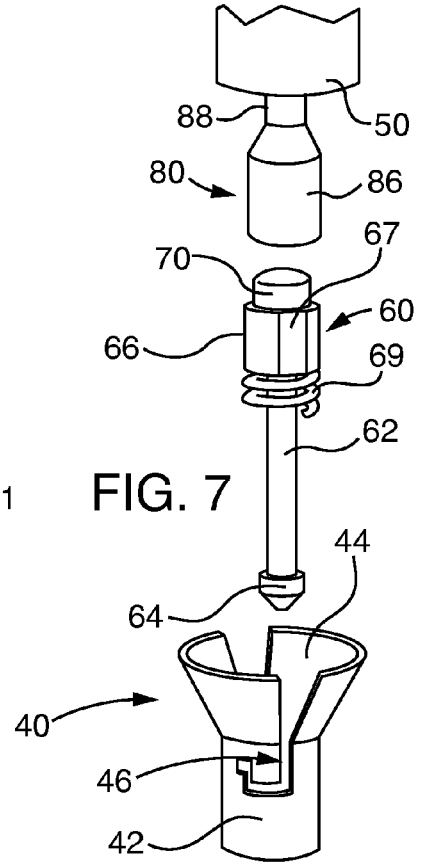
FIG. 7 is an exploded view of the common alignment of the inspection port, port plug, stub tube and port plug service tool of FIGS. 5 and 6 that are oriented in axial alignment at the 12 o'clock or top radial position on the turbine casing.

Other inspection port system components are shown in greater detail in FIGS. 5-7. The inspection port system includes an inspection port 40 for receipt of a port plug 60. The inspection port 40 comprises a generally cylindrical port body 42, having a distal end for affixation to the gas turbine casing 28 in general axial alignment with the inspection opening seat 34 and inspection opening 32 that are defined by the gas turbine casing. A funnel 44 (here a split funnel) on a proximal end of the port body 42 receives and guides the port plug 60. The inspection port 40 also has gas turbine inspection port securing mechanism 46 for retention engagement with a corresponding plug securing mechanism 68 when the plug 60 is inserted into the inspection port body 42. Structural details of the respective inspection port and plug securing mechanisms 46, 68 and their cooperative interaction will be described in greater detail herein.

As previously described, each inspection port plug 60 seals its respective corresponding gas turbine casing inspection opening 32. Embodiments of the inspection plug 60 feature an elongated plug shaft 62 with a plug seating surface 64 on a distal end of the plug shaft, for sealing engagement with a mating inspection opening seat 34 defined by a gas turbine engine casing upon insertion of the plug shaft into a gas turbine inspection port body 42. A plug cap 66 is oriented on a proximal end of the plug shaft 62 and preferably includes one or more drive surfaces 67 for engagement with a corresponding drive surface of a plug service tool 80 mating socket 86.

The plug service tool 80 and its socket 86 facilitates installation and removal of the port plug 60 remotely from the turbine 20 exterior, through the stub pipe 50 by pushing and/or rotating the plug cap drive surfaces 67 and its securing mechanism 68 relative to its corresponding inspection port securing mechanism 46. The service tool shaft 88 has sufficient length to reach the port plug 60 and rotation is imparted on the plug by application of torque on the T handle 90. The service tool 80 also has an electromagnet 82 that is oriented within the socket 86. An electromagnetic field B is generated passing current from a current source 84 through the electromagnet 82.

Figure 12:
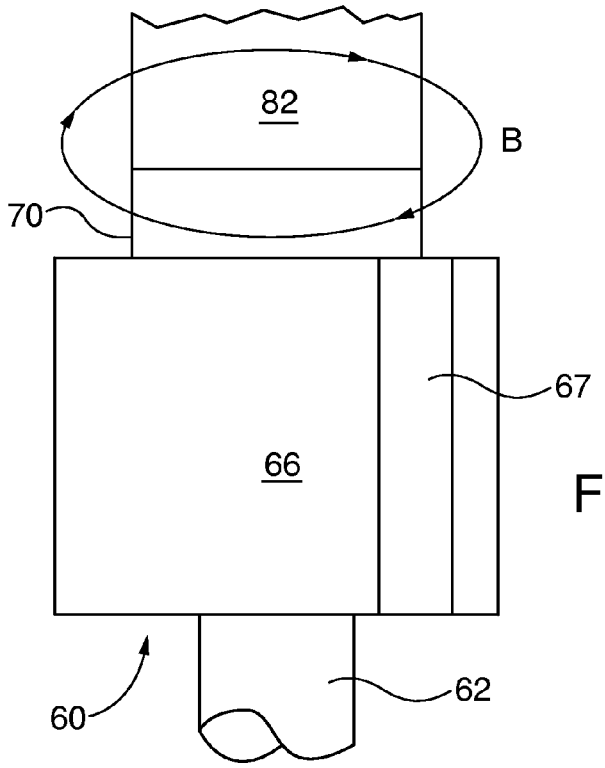
FIG. 12 is an elevational view of a port plug solid pole piece embodiment of the invention.
Figure 13:
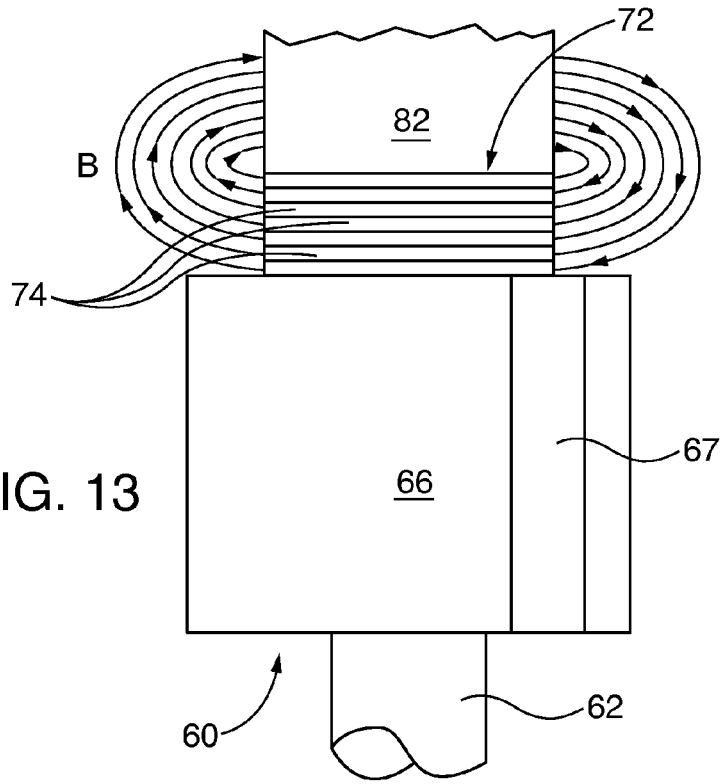
FIG. 13 is an elevational view of a port plug laminated pole piece embodiment of the invention.

In this invention the port plug 60 is selectively magnetically coupled to the plug service tool 80 electromagnet 82 for precise remote alignment and manipulation of the plug as it is inserted or withdrawn from the gas turbine 20. Magnetic coupling of the plug 60 and service tool 80 also reduces likelihood of inadvertent dropping of the plug into the turbine 20 interior. The inspection plugs 60 are generally constructed of a heat resistant metal alloy, such as an Inconel® superalloy that has a relatively low (or functionally non-existent) first magnetic permeability that is too low for sufficient direct magnetic coupling with the service tool 80. Accordingly the plug 60 has a magnetically attractive pole piece 70 that is constructed of material having a second magnetic permeability greater than that of the plug cap 66/shaft 62/plug seating surface 64 first magnetic permeability. Referring to FIGS. 6, 12 and 13, the pole piece 70 is oriented on the plug cap 66, which is in turn in proximity to the plug shaft 62 proximal end, for concentration or redirection of the attractive magnetic field circuit B generated by the service tool 80 electromagnet 82 and its corresponding current source 84 during plug 60 insertion or retrieval. As shown in FIG. 12 the pole piece 70 may be constructed from a solid disc or block of ferromagnetic material, such as motor stator or solenoid grade steel. Alternatively, as shown in FIG. 13 the a laminated pole piece 72 may constructed from individual insulated stacked ferromagnetic lamina 74 to increase and focus the magnetic field strength B. Other pole piece materials and configurations may be employed to alter magnetic field orientation and/or attractive force. A permanent magnet may be substituted for the electromagnet 82.

Figure 8:
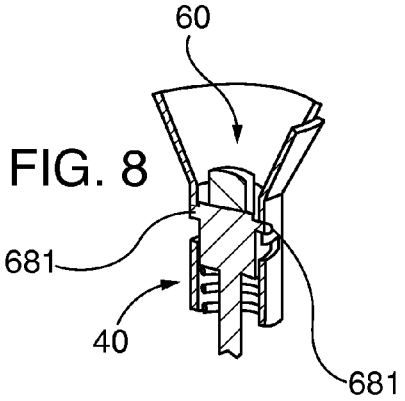
FIG. 8 is a cut away perspective view of a port plug and inspection port of the invention with mating lug and slot securing mechanisms for retention of the plug in seating engagement with the turbine casing inspection opening by insertion and rotation of the port plug relative to the inspection port.
Figure 9:
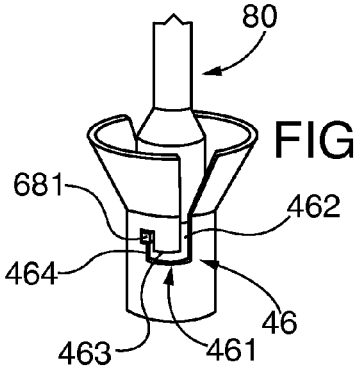
FIG. 9 is an external elevational perspective view of the port plug and inspection port of FIG. 8.
Figure 10:
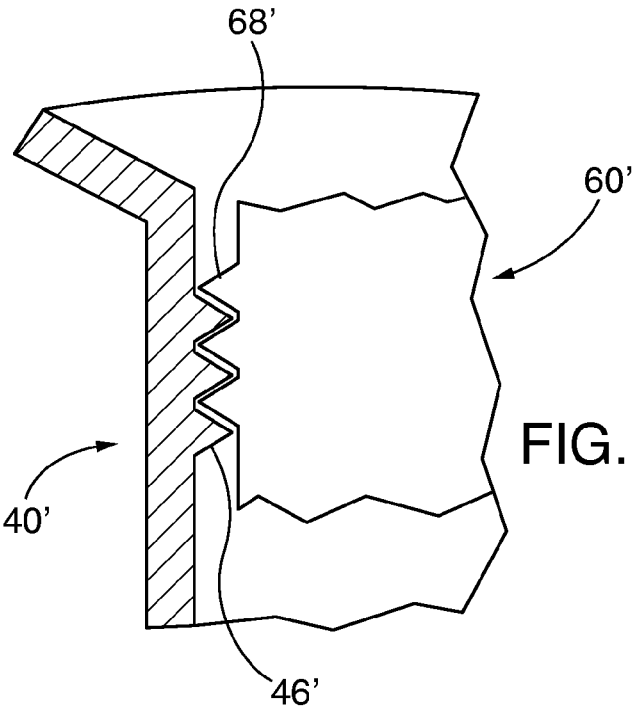
FIG. 10 is a detailed cross sectional view of an embodiment of mating threaded port plug and inspection port securing mechanisms.
Figure 11:
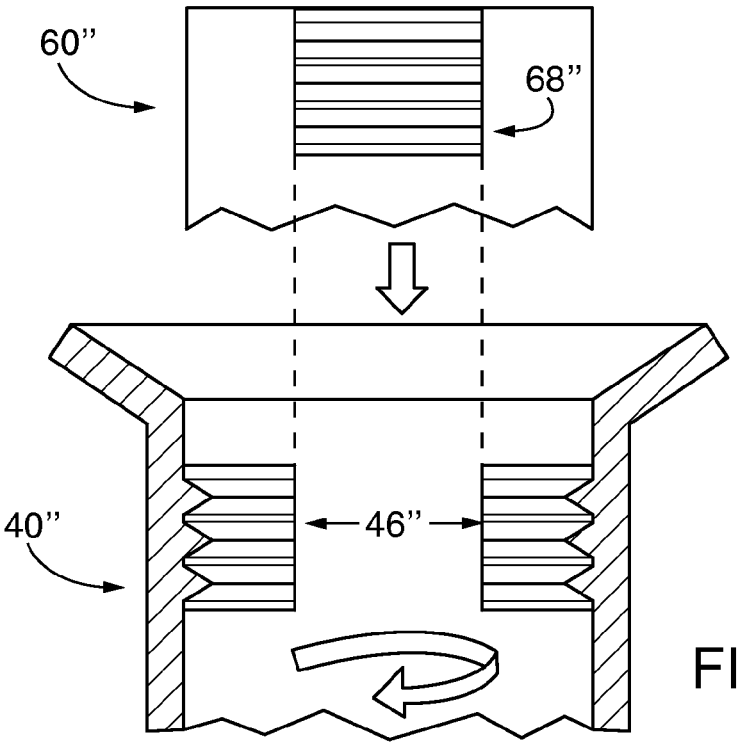
FIG. 11 is a detailed cross sectional view of an embodiment of mating interrupted thread port plug and inspection port securing mechanisms that engage by insertion and rotation of the port plug relative to the inspection port.

FIGS. 8-11 show alternative embodiments of port securing mechanisms 46 and complimentary engaging plug securing mechanisms 68. In FIGS. 8 and 9 the plug securing mechanism is a J slot 461 having a J slot entry portion 462, a J slot transverse portion 463 and a J slot locking portion 464 that receives a corresponding lug or pin 681 that is formed in the plug 60 cap 66. One-piece helical spring 69 is a biasing element that biases the pin 681 relative to the J slot 461 for secure locking of the port and plug securing mechanisms. The mating J slot 461 and pin 681 are engaged by twist locking the plug 60 with the service tool 80 as the plug is inserted and seated within the inspection port cylindrical body 42. In FIG. 10 the port and plug securing mechanisms comprise mating corresponding threads 68' defined by plug 60' and 46' defined by the plug port 40'. The plug 60' is rotated with the service tool 80 to cause advancing engagement of the mating threads 68' and 46'. Thread engagement securing mechanisms 46', 68' are suitable for relatively high dynamic pressure inspection rows within a gas turbine compressor section. In FIG. 11 the mating threads 68" formed in the plug 60" and threads 46" formed in the inspection port 40" are interrupted threads for insertion of the plug 60" with the service tool 80 into the inspection port 40" and subsequent rotation to secure the plug therein.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. For example, the port plug and inspection port body securing mechanisms mating engagement portions shown in the figures may be reversed. Other known designs of pole pieces may be substituted for the constructions and configurations shown in the figures. The port plug service tool may utilize other types of known drive surfaces other than a socket. Similarly, a permanent magnet may be substituted for the electromagnet shown in the figures. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

What is claimed is:

1. A gas turbine inspection port plug apparatus for insertion into a mating gas turbine inspection port of a turbine inspection port system that is coupled to a gas turbine engine casing, comprising:

an elongated plug shaft, constructed of a material having a first magnetic permeability, for insertion into a mating gas turbine inspection port;

a plug seating surface on a distal end of the plug shaft, for sealing engagement with a mating inspection opening seat defined by a gas turbine engine casing upon insertion of the plug shaft into a gas turbine inspection port;

a plug cap on a proximal end of the plug shaft; and a magnetically attractive pole piece constructed of material having a second magnetic permeability greater than the first magnetic permeability, oriented in proximity to the plug shaft proximal end, for concentration or redirection of an attractive magnetic field circuit generated by an inspection port plug service tool during plug insertion or retrieval.

2. The apparatus of claim 1, the pole piece comprising a magnetic lamina stack coupled to the plug cap.

3. The apparatus of claim 1, further comprising:

a plug securing mechanism, for retention engagement with a complementary gas turbine inspection port securing mechanism when the plug is inserted into an inspection port, the plug securing mechanism comprising threads defined by the plug cap for engagement with complementary threads of a turbine inspection port securing mechanism.

4. The apparatus of claim 3, the threads comprising interrupted threads for insertion of the plug into an inspection port and subsequent rotation to secure the plug therein.

5. The apparatus of claim 1, further comprising:

a plug securing mechanism, for retention engagement with a complementary gas turbine inspection port securing mechanism when the plug is inserted into an inspection port, the plug securing mechanism having lugs or lug-receiving slots formed in the plug for twist-lock engagement with corresponding mating lugs or slots formed in a complimentary gas turbine inspection port securing mechanism, and a biasing element coupled to the plug for axially biasing the plug securing mechanism relative to a complimentary gas turbine inspection port securing mechanism.

6. A gas turbine inspection port closure system including the plug apparatus of claim 1, further comprising an inspection port plug service tool having a magnetic tip for generation of an attractive magnetic field circuit with the plug pole piece during plug insertion or retrieval.

7. The closure system of claim 6, the service tool magnetic tip comprising an electromagnet or a permanent magnet.

8. The closure system of claim 6, the inspection port service tool having a drive surface for engagement with a complimentary surface formed in the plug cap, for rotating the port plug securing mechanism relative to a gas turbine inspection port securing mechanism when the plug is inserted into an inspection port.

9. A gas turbine inspection port system including the plug apparatus of claim 1, further comprising an inspection port for receipt of the plug apparatus, the inspection port comprising:

a generally cylindrical port body having a distal end for affixation to a gas turbine casing in general axial alignment with an inspection opening seat defined by the gas turbine casing;

a funnel on a proximal end of the port body, for receiving the plug apparatus distal end therein; and a gas turbine inspection port securing mechanism for retention engagement with the plug securing mechanism when the plug is inserted into the inspection port body.

10. The port system of claim 9, the plug securing mechanism comprising threads defined by the plug cap for engagement with complementary threads of the turbine inspection port securing mechanism.

11. The port system of claim 10, the threads comprising interrupted threads for insertion of the plug into the inspection port and subsequent rotation to secure the plug therein.

12. The port system of claim 9, the plug securing mechanism comprising lugs or lug-receiving slots formed in the plug for twist-lock engagement with corresponding mating lugs or slots formed in the gas turbine inspection port securing mechanism; and a biasing element coupled to the plug for axially biasing the plug securing mechanism relative to a complimentary gas turbine inspection port securing mechanism.

13. The port system of claim 9, the pole piece comprising a magnetic lamina stack coupled to the plug cap.

14. A gas turbine engine including the inspection port system of claim 9, comprising:

a turbine casing enclosing plural axially spaced rows of vanes and blades that are oriented radially about a turbine shaft;

plural axially aligned inspection openings defined by the turbine casing, each having an inspection opening seat;

a plurality of inspection ports affixed to the turbine casing in general axial alignment with each respective inspection opening seat, the respective port bodies having identically dimensioned internal length and diameter;

a plurality of generally cylindrical stub tubes affixed to and projecting outwardly from the turbine casing, having identical external flanges and inner diameters, in general axial alignment with each respective inspection opening seat and respective inspection port body, with axial length of each stub tube chosen so that distance from its respective external flange to its corresponding respective inspection opening seat is identical.

15. The gas turbine engine of claim 14, each corresponding stub tube, inspection port and inspection opening seat aligned axially and radially at a 6 o'clock or a 12 o'clock position or at both positions.

16. A method for servicing an inspection port plug adapted for sealing an inspection port of a gas turbine engine inspection port system, comprising:

providing a gas turbine engine having:

a turbine casing enclosing plural axially spaced rows of vanes and blades that are oriented radially about a turbine shaft;

an axially aligned inspection opening defined by the turbine casing, having an inspection opening seat; and an inspection port affixed to the turbine casing in general axial alignment with the inspection opening seat, the inspection port having a generally cylindrical port body, a funnel on a proximal end of the port body, and a gas turbine inspection port securing mechanism;

providing an inspection port plug having:

an elongated plug shaft, constructed of a material having a first magnetic permeability, for insertion into the gas turbine inspection port;

a plug seating surface on a distal end of the plug shaft, for sealing engagement with the mating inspection opening seat defined by a gas turbine engine casing upon insertion of the plug shaft into the inspection port;

a plug cap on a proximal end of the plug shaft;

a plug securing mechanism, for retention engagement with the complementary gas turbine inspection port securing mechanism when the plug is inserted therein; and a magnetically attractive pole piece constructed of material having a second magnetic permeability greater than the first magnetic permeability, oriented in proximity to the plug shaft proximal end, for concentration or redirection of an attractive magnetic field circuit generated by an inspection port plug service tool during plug insertion or retrieval;

providing an inspection port plug service tool having a magnetic tip for generation of an attractive magnetic field circuit with the plug pole piece during plug insertion or retrieval; and when installing the port plug within the gas turbine:

magnetically coupling the service tool magnetic tip and the pole piece, so that the inspection port plug is affixed to the service tool;

inserting the inspection port plug seating surface and plug into the inspection port funnel with the service tool and advancing the plug seating surface into contact with the turbine casing inspection opening seat;

engaging the respective mating plug and inspection port securing mechanisms for retaining the port plug in the inspection port; or when removing the port plug from the gas turbine:

disengaging the respective mating plug and inspection port securing mechanisms so that the port plug is separable from the inspection port;

magnetically coupling the service tool magnetic tip and the pole piece, so that the inspection port plug is affixed to the service tool; and withdrawing the port plug from the inspection port and gas turbine.

17. The method of claim 16, further comprising internally inspecting a gas turbine engine by:

removing the port plug from the gas turbine;

inserting a turbine inspection tool into the inspection port and performing an internal turbine inspection with the inspection tool;

withdrawing the inspection tool; and reinstalling the port plug in the gas turbine engine.

18. The inspection method of claim 17 performed in a gas turbine engine having a turbine casing enclosing plural axially spaced rows of vanes and blades that are oriented radially about a turbine shaft, plural axially aligned inspection openings defined by the turbine casing, each having an inspection opening seat, a port inspection system having a plurality of inspection ports affixed to the turbine casing in general axial alignment with each respective inspection opening seat, the respective port bodies having identically dimensioned internal length and diameter, and a plurality of generally cylindrical stub tubes affixed to and projecting outwardly from the turbine casing, having identical external flanges and inner diameters, in general axial alignment with each respective inspection opening seat and respective inspection port body, with axial length of each stub tube chosen so that distance from its respective external flange to its corresponding respective inspection opening seat is identical, each corresponding stub tube, inspection port and inspection opening seat aligned axially and radially at a 6 o'clock or a 12 o'clock position or at both positions; the method further comprising:

advancing and withdrawing the inspection tool clockwise and counter-clockwise in each inspection report in order to inspect each blade or vane in an axial row about the entire circumference of the turbine, so as to obtain inspection information about all blades and vanes within the inspected rows.

19. A gas turbine engine, comprising:

nested inner and outer turbine casings enclosing plural axially spaced rows of vanes and blades that are oriented radially about a turbine shaft;

plural axially aligned inspection openings defined by the inner turbine casing, each having an inspection opening seat;

a plurality of inspection ports affixed to the inner turbine casing in general axial alignment with each respective inspection opening seat, each inspection port having:

a generally cylindrical port body having a distal end for affixation to the inner casing in general axial alignment with an inspection opening seat defined by the inner casing, the respective port bodies having identically dimensioned internal length and diameter;

a funnel on a proximal end of the port body facing the outer casing; and a gas turbine inspection port securing mechanism;

a plurality of generally cylindrical stub tubes affixed to and projecting outwardly from the outer turbine casing, having identical external flanges and inner diameters, in general axial alignment with each respective inspection opening seat and respective inspection port body, with axial length of each stub tube chosen so that distance from its respective external flange to its corresponding respective inspection opening seat is identical;

each corresponding stub tube, inspection port and inspection opening seat aligned axially and radially at a 6 o'clock or a 12 o'clock position or at both positions; and plural gas turbine inspection port plugs for insertion into a mating gas turbine inspection port; each port plug having:

an elongated plug shaft, constructed of a material having a first magnetic permeability, for insertion into a mating gas turbine inspection port;

a plug seating surface on a distal end of the plug shaft, for sealing engagement with a mating inspection opening seat defined by a gas turbine engine casing upon insertion of the plug shaft into a corresponding gas turbine inspection port;

a plug cap on a proximal end of the plug shaft;

a plug securing mechanism, for retention engagement with a complementary gas turbine inspection port securing mechanism when the plug is inserted into an inspection port; and a magnetically attractive pole piece constructed of material having a second magnetic permeability greater than the first magnetic permeability, oriented in proximity to the plug shaft proximal end, for concentration or redirection of an attractive magnetic field circuit generated by an inspection port plug service tool during plug insertion or retrieval.

20. An inspection port plug service tool for servicing the gas turbine engine of claim 19, the tool comprising: an electromagnet or a permanent magnet forming a magnetic tip for generation of an attractive magnetic field circuit with the plug pole piece during plug insertion or retrieval.

* * * * *